United States Patent [19]

Passien

[11] Patent Number: 4,531,257

[45] Date of Patent: Jul. 30, 1985

[54] APPARATUS FOR CLEANING CARPET

[76] Inventor: Ray Passien, Rte. 3, Box 291, Klamath Falls, Oreg. 97601

[21] Appl. No.: 550,366

[22] Filed: Nov. 10, 1983

[51] Int. Cl.[3] ..... A47L 11/34

[52] U.S. Cl. ..... 15/321; 15/328

[58] Field of Search ..... 15/320, 321, 328

[56] References Cited

U.S. PATENT DOCUMENTS

| | | | |
|---|---|---|---|
| 4,123,818 | 11/1978 | Hurwitz | 15/321 |
| 4,218,805 | 8/1980 | Brazier | 15/321 |
| 4,327,459 | 5/1982 | Gilbert | 15/321 |
| 4,397,057 | 8/1983 | Harbeck | 15/321 |

FOREIGN PATENT DOCUMENTS

| | | | |
|---|---|---|---|
| 2425830 | 1/1980 | France | 15/321 |

*Primary Examiner*—Chris K. Moore

*Attorney, Agent, or Firm*—Dority & Manning

[57] ABSTRACT

Apparatus for wet cleaning carpet is disclosed of the type which utilizes a wet-dry tank unit (C) having a vacuum hose (56) connected to the vacuum tank and a vacuum head (52). The apparatus includes a portable base (A) for moving the apparatus over the floor having a socket (12) formed in the portable base. A cleaning solution tank (B) for containing a cleaning solution includes a lower attachment collar (D) which fits in the socket (12). A liquid pump (40) is carried in a pump housing (30) formed in solution tank (B). An upper attachment recess (66) formed in solution tank (B) receives a base (74) of the vacuum unit (C). The portable base (A), solution tank (B), and vacuum unit (C) are snugly fitted together by means of a deep socket (12) and recess (66) to provide an integrally assembled structure. By housing the pump (40) low to the floor in the portable base (A), a low center of gravity and stable weight distribution is provided.

16 Claims, 2 Drawing Figures

APPARATUS FOR CLEANING CARPET

BACKGROUND OF THE INVENTION

Heretofore, there have been many types of machines proposed for cleaning carpet such as the steam cleaning machines and other deep cleaning machines which exact a heated or other cleaning solution into the carpet and thereafter extract the residual cleaning solution and dirt from the carpet by means of a vacuum system. Other methods of cleaning carpets have also been proposed which include either dry chemicals or separate application of the cleaning solution to the carpet along with different methods of extracting the solution and dirt from the carpet.

It has also been known to provide wet type vacuum cleaners which will vacuum up water from a carpet. These are particularly useful when flooding or other water damage has occurred and it is desired to vacuum up the water from the carpet. These types of wet-dry vacuum cleaners can be used either on wet carpet or dry carpet. It is also possible to spray or apply a cleaning solution on the carpet and then extract it by means of a wet-dry vacuum cleaner.

It has also been proposed in U.S. Pat. No. 4,138,760 to provide an attachment to a conventional wet-dry vacuum cleaner which includes a fluid tank containing a cleaning solution. The tank includes a small electric pump and a flexible solution delivery line equipped with a switching valve which switches on the pump when the valve is open to supply cleaning solution directly to the floor at the vacuum head of the wet-dry vacuum unit. In this manner, the wet-dry vacuum cleaner is converted to a cleaning apparatus and the cleaning solution is delivered simultaneously to the carpet as the vacuum unit extracts and vacuums the solution and dirt away. However, the problem occurs with such an apparatus that the fluid tank is mounted over the top of the vacuum unit and depends downwardly from the top of the vacuum unit over the exterior walls of the unit. When the fluid tank is filled with a cleaning solution, there is a very high center of gravity and it is very top heavy. It often is the case that the entire unit can be turned over rather easily.

Other vacuum wet cleaning machines are shown in U.S. Pat. Nos. 4,367,565 and 4,226,000 wherein the latter utilize separated vacuum and wet tanks.

Accordingly, an important object of the present invention is to provide apparatus for cleaning carpets which can be utilized with a wet-dry type vacuum unit.

Still another important object of the present invention is to provide a carpet cleaning apparatus which includes a cleaning solution tank fitted with a wet-dry vacuum unit which has a low center of gravity and a highly stable configuration when fitted together for transportation and use.

Still another important object of the present invention is to provide an apparatus for converting a wet-dry vacuum unit to a wet carpet cleaning unit wherein a carpet cleaning solution tank is provided which is fitted to a base unit of the apparatus and includes a pump housing which is fitted in a lowermost portion of the solution tank which depends downwardly through a socket in a portable base such that it is positioned closely adjacent the floor and provides a highly stable weight distribution for the apparatus in use.

Still another important object of the present invention is to provide a portable base, a carpet cleaning solution tank, and a wet-dry vacuum unit, which are fitted together in a tight and highly stable configuration for ease and stability in maneuvering the apparatus during use.

SUMMARY OF THE INVENTION

The above objectives are accomplished according to the present invention by providing a solution tank for containing a carpet cleaning solution which includes a lower downwardly depending annular collar which fits into an annular socket of a portable base of the vacuum unit. The solution tank further includes an annular recess in a top portion which has a recess bottom surface on which a base portion of the vacuum unit rests and is supported. The annular recess has a vertical annular wall with a sufficient height that covers a substantial portion of the base of the vacuum unit to contain it in an integral manner. The annular collar of the solution tank contains a housing for a pump such that the pump is carried substantially within the open socket of the base portion and closely adjacent the floor such that a low center of gravity and stable weight distribution is provided .

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRITPION OF A PREFERRED EMBODIMENT

Figure 1:
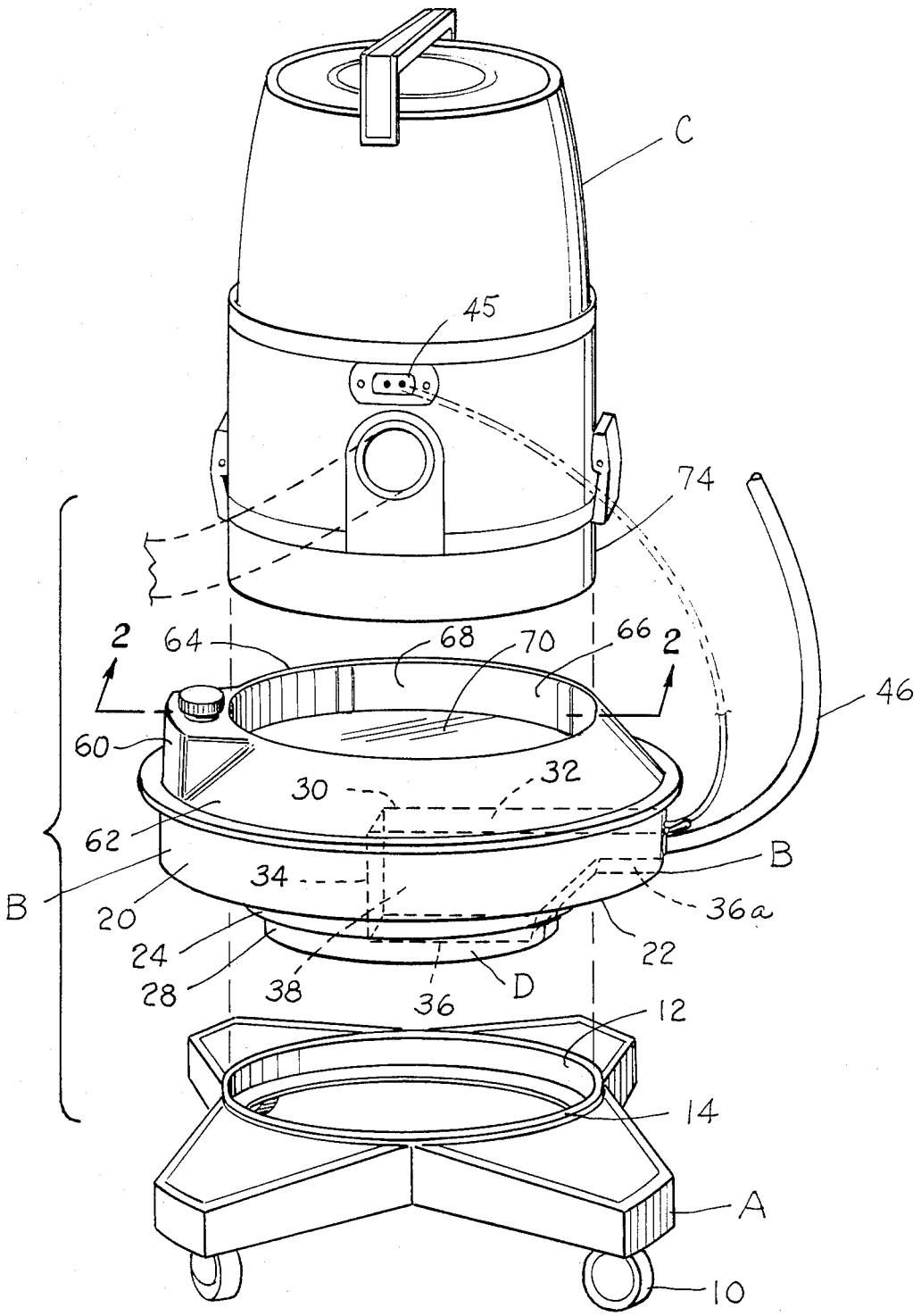
FIG. 1 is view with parts separated showing carpet cleaning apparatus constructed according to the present invention.
Figure 2:
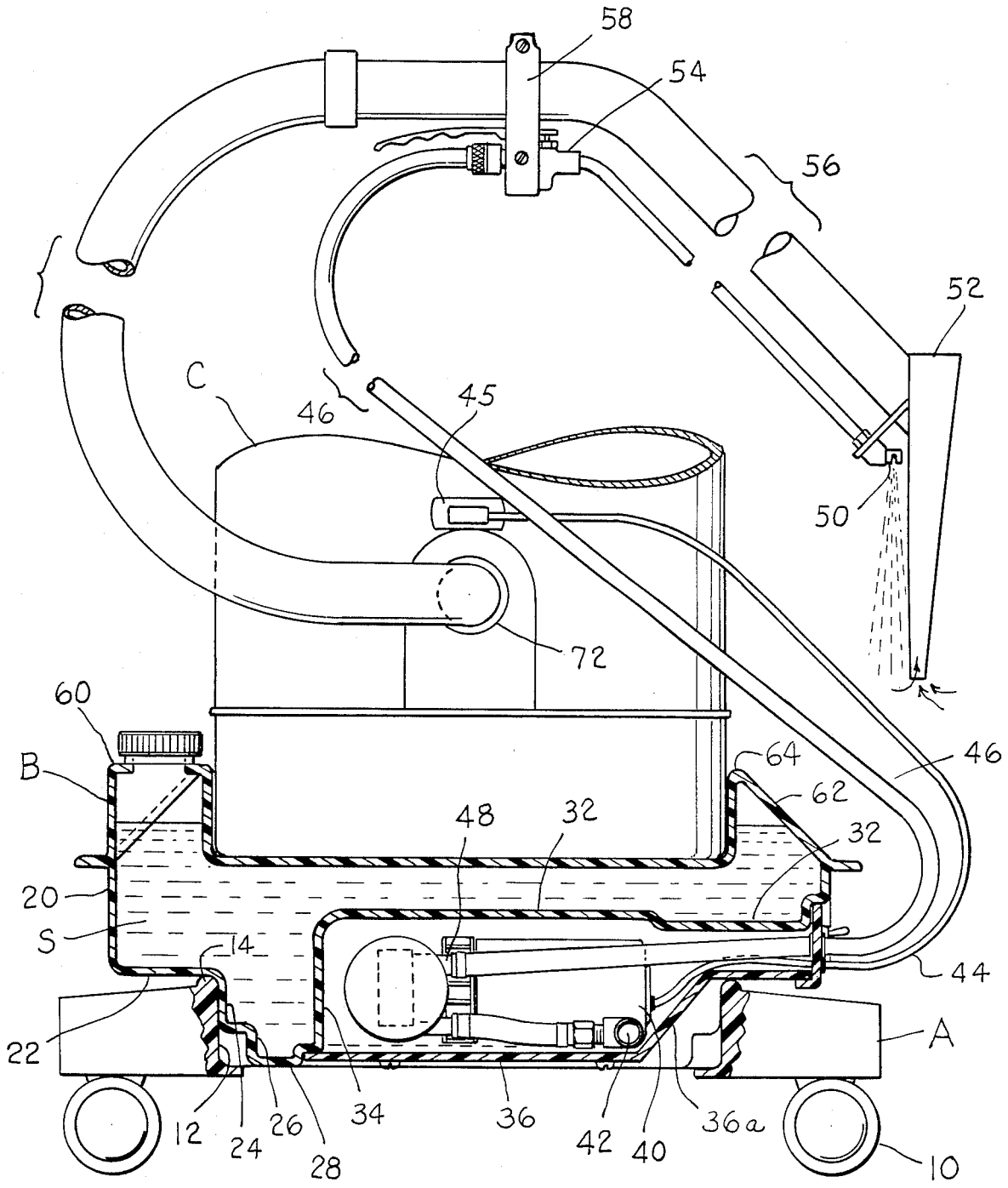
FIG. 2 is a elevation with parts cut away illustrating apparatus for use with a wet-dry vacuum unit for cleaning carpet according to the invention.

Referring now in more detail to the drawings, apparatus for cleaning carpet is illustrated wherein a wet-dry vacuum unit may be utilized to clean carpet with a liquid solution as well as vacuum the carpet in either the wetted or a dry condition. The apparatus includes a portable base A, a cleaning solution tank B and a wet-dry vacuum unit C.

The portable base includes caster roller wheels 10 which support the portable base above the floor and by which the apparatus may be rolled over the floor for cleaning and transportation. The portable base further includes an open socket 12 which has an annular configuration. A rim 14 extends upwardly and around the socket and forms a support member for the solution tank B.

Referring now in more detail to the solution tank B, the tank includes a first generally vertical wall means 20 which encircles the container. A generally horizontal wall means 22 is integral with the vertical wall means and terminates in a downwardly depending generally vertical wall means 24 which includes a stepped wall portion 26 which terminates at a bottom portion 28. The horizontal wall means 22 rests on the rim 14 of the socket 12 to support the solution container B on the portable base. As can be seen, the vertical wall means 24, 26 fit within the open socket 12 and form a lower attachment body portion in the form of an annular collar D for attaching the solution tank and portable base together in an integral stable fashion.

A waterproof pump housing 30 is formed within the solution tank B and includes an upper wall 32, a rear wall 34, a bottom wall 36, and 36*a*, and side walls 38. The entire solution tank B may be molded as one-piece and the back wall 34 and top wall 32 are, in this case, molded as parts of the solution tank. There is a liquid pump 40 carried in the pump housing which may be an electric pump and includes a conduit 42 on the suction side of the pump which opens into the interior of the solution tank B in fluid communication with a cleaning solution S carried therein. A power line 44 leads from the liquid pump to an electrical accessory receptacle 45 carried on the vacuum unit C. There is a liquid supply line 46 connected to the discharge side 48 of the pump 40 for delivering cleaning solution to a spray nozzle 50 carried adjacent the vacuum head 52 of the vacuum unit C.

A switching valve 54 is carried in the supply line 46 for selectively opening and closing the supply line 46. The motor 40 of the pump may be controlled directly by an electrical switch connected in the valve 54 such that when valve 54 is open the pump motor cuts on and vice versa. Alternately, the valve may be a pressure operative valve. Opening of the valve creates a pressure drop at the pressure side of the pump which can be sensed by a pressure responsive electrical switch (not shown) to close the contacts of a solenoid and energize the pump motion. The valve 54 may be clamped to the vacuum hose 56 of the vacuum unit by means of a clamp 58.

A fill spout 60 is provided on a neck of the solution tank B. The upper portion of the solution tank includes the filler neck 60 and an inclined wall means 62 is inclined upwardly and terminates at an edge 64 of an annular recess 66. The annular recess is defined by a generally vertical recess wall means 68 and an integral recess lower surface 70 all of which form a part of the solution tank enclosure.

The vacuum unit B may be any conventional vacuum unit and is illustrated as one manufactured by under the mark Rainbow by the Rainbow Mfgr. Co. The vacuum unit typically includes a vacuum hose 56 snap-coupled at 72 to the vacuum cleaner so as to make communication with the vacuum chamber inside the vacuum unit. The vacuum unit includes a base portion 74 which is circular in its periphery and fits snugly within the recess wall 68 of the recess 66 formed in the upper attachment portion of the solution tank.

Thus, it can be seen that an advantageous construction for apparatus for cleaning carpet can be had according to the present invention wherein a wet-dry vacuum unit can be utilized to wet clean carpet. The invention contemplates the adaptation of a base unit C to include a wet solution tank B which fits tightly in a socket of the portable base. The solution tank, which is heavy due to being filled with water and containing a pump, is thus hung in the base unit and carried low to the floor. The vacuum unit B is fitted snugly in the recess attachment portion of the solution tank. Thus, when the portable base, solution tank, and vacuum unit are fitted together they are snugly fitted with one another and have a low center of gravity whereby a very stable adaptation and apparatus for wet cleaning carpet can be had.

While a preferred embodiment of the invention has been described using specific terms, such description is for illustrative purposes only, and it is to be understood that changes and variations may be made without departing from the spirit or scope of the following claims.

What is claimed is:

1. Apparatus for cleaning carpet of the type havinga wet-dry vacuum tank unit and a vacuum hose connected to said vacuum tank having a vacuum head, a portable base for supporting and moving said apparatus above the floor, socket means carried by said portable base, said apparatus comprising:

a cleaning solution tank for containing a cleaning solution having a pump housing formed therein;

a liquid pump carried in said pump housing having a suction side adapted for connection to said cleaning solution contained in said solution tank;

said liquid pump having a pressure side adapted for connection to a flexible solution delivery hose for delivering cleaning solution to the carpet;

a lower attachment body portion included in said solution tank having a configuration generally conforming to that of said socket means so that a generally one-to-one fi is had between said socket means of said portable base and said lower attachment body portion of said solution tank;

an upper attachment body portion formed on an upper surface of said solution tank having a contoured attachment surface for attachably mating with said vacuum tank unit; and a base portion of said vacuum tank and said upper attachment body portion of said solution tank having a generally one-to-one fit for mating together so that said portable base, solution tank, and vacuum tank are fitted together in an integral stable configuration;

said base portion of said vacuum tank having a configuration generally conforming to that of said socket means so that a generally one-to-one fit is had between the base portion of said vacuum tank and said socket means;

whereby said solution tank can be readily removed from and inserted into said socket means when it is desired to change from a wet type vacuum cleaner to a regular vacuum cleaner.

2. The apparatus of claim 1 comprising:

said socket means including a hollow socket formed in said portable base;

said solution cleaning tank including vertical side wall means enclosing said tank, a generally horizontal lower wall means, lower vertical side wall means depending downwardly from said horizontal lower wall means;

said lower vertical side wall means fitting in said socket of said socket means to define said lower attachment body portion and provide said one-to-one attachment fit.

3. The apparatus of claim 2 wherein said socket and said lower vertical side wall means defining said lower attachment body portion are annular in their configuration.

4. The apparatus of claim 2 wherein said pump housing in said solution tank is formed generally in said lower attachment body portion of said solution tank which fits within said socket so that said liquid pump creating a low center of gravity and a highly stable weight distribution.

5. The apparatus of claim 2 including a rim formed around said socket, said lower generally horizontal wall means of said solution tank being engaged and supported by said rim.

6. The apparatus of claim 2 wherein said upper body attachment portion includes a recess conforming generally to the shape of said base portion of said vacuum tank.

7. The apparatus of claim 6 comprising:

a vertical recess wall means defining said recess having a depth and extending upwardly past a base wall of said base portion sufficiently to receive and contain said base portion in a stable manner therein;

a bottom horizontal recess surface integral with said vertical recess wall means; and said base portion have a base surface which is supported on said bottom recess surface.

8. The apparatus of claim 7 wherein said attachment recess and base portion have an annular configuration.

9. Apparatus for cleaning carpet of the type having a wet-dry vacuum tank unit, a vacuum hose connected to said vacuum tank, a vacuum head connected to said vacuum hose, a lower portable base for supporting and moving said apparatus above the floor having an open socket formed therein, said apparatus comprising:

a solution tank for containing a cleaning solution having a lower attachment portion which fits within said open socket of said portable base for attaching said portable base and solution tank tightly with one another;

an upper attachment portion formed on said solution tank having a contoured recess;

said contoured recess being contoured to receive a base portion of said vacuum tank to provide a generally one-to-one fit between said base portion and said recess so that said portable base, solution tank, and vacuum tank are fitted together in an integral stable configuration;

a pump housing formed in said solution tank for containing a liquid pump having a suction side adapted for connection to said cleaning solution contained in said solution tank;

said pump housing being formed in said lower attachment portion of said solution tank so that said liquid pump is housed substantially within said portable base closely adjacent and above the floor so that a lower center of gravity and stable weight distribution is provided and said portable base, solution tank, and vacuum tank integrally fitted together in a highly stable configuration, and said base portion of said vacuum tank having a configuratin generally conforming to that of said open socket in said lower portable base so that a generally one-to-one fit is had between said base portions of said vacuum tank and said open socket whereby said solution tank can be readily removed from and inserted into said socket means when it is desired to change from a wet type vacuum cleaner to a regular vacuum cleaner.

10. The apparatus of claim 9 wherein said recess of said solution tank includes an annular recess wall and an integral bottom surface, said base portion of said vacuum tank including a base surface which rests and is supported on said bottom surface of said recess, said bottom surface of said recess being solid across the top portion of said solution tank to provide an enclosed container.

11. The apparatus of claim 9 wherein said solution tank includes a first generally vertical wall means, a generally horizontal wall means integral with said first vertical wall means, and a second generally vertical wall means depending downwardly from said horizontal wall means, said second generally vertical wall means being received in said open socket of said portable base means and being included in said lower attachment portion.

12. The apparatus of claim 11 wherein said generally horizontal wall means of said solution tank rests upon a rim of said socket of said portable base.

13. Apparatus for cleaning carpet of the type havinga wet-dry vacuum tank unit, a vacuum hose connected to said vacuum tank having a vacuum head, and accessory power receptacle carried by said vacuum unit for connecting an electrical accessory to electrical power, said apparatus comprising:

a portable base for supporting and moving said apparatus above the floor to be cleaned;

socket means carried by said portable base which includes an open socket;

a solution tank for containing a cleaning solution having a pump housing formed therein;

a liquid pump carried in said pump housing having a suction side adapted for connecting to said cleaning solution contained in said solution tank and a pressure side adapted for delivery of cleaning solution outwardly from said tank;

an electrical power lead connecting said liquid pump and said auxiliary power receptacle of said vacuum unit;

flexible solution delivery hose connected to said pressure side of said pump for delivering said cleaning solution to said carpet to be cleaned;

a lower attachment portion included in said solution tank having a configuration generally conforming to that of said open socket of said portable base so that a generally one-to-one fit is had between said socket and said lower attachment portion of said solution tank;

an upper attachment portion formed on said solution tank having a contoured recess;

a base portion of said vacuum tank fitting within said contoured recess of said solution tank so that a generally one-to-one fit is had between said vacuum unit base portion and said contoured recess of said solution tank; and said portable base, solution tank, and vacuum tank being integrally joined and fitted together in a generally one-to-one relationship to provide a stable configuration for said apparatus in use, and said base portion of said vacuum tank having a configuration generally conforming to that of said socket means in said portable base so that a generally one-to-one fit is had between said base portion of said vacuum tank and said socket means whereby said solution tank can be readily removed from and inserted into said socket means when it is desired to change from a wet-type vacuum cleaner to a regular vacuum cleaner.

14. The apparatus of claim 13 wherein said socket and said lower attachment portion of said solution tank have an annular configuration, and said contoured recess and base portion of said vacuum tank have an annular configuration which are dimensioned to provide a snug tight fit therebetween.

15. The apparatus of claim 13 wherein said pump housing is formed in said lower attachment portion of said solution tank so that said liquid pump housed in said pump housing is carried substantially within said portable base and closely adjacent the floor over which said apparatus is moved providing a low center of gravity and high degree of weight stability to said apparatus.

16. The apparatus of claim 13 wherein said solution tank includes a horizontal bottom surface which rests upon a rim formed around said open socket of said portable base, and said lower attachment portion depends downwardly into said portable base.

* * * * *